US008535182B2

(12) United States Patent
Christenson

(10) Patent No.: US 8,535,182 B2
(45) Date of Patent: Sep. 17, 2013

(54) SYSTEM AND METHOD FOR PROVIDING A PERFORMANCE FACTOR FOR A PITCHER

(75) Inventor: Charles Allen Christenson, Omaha, NE (US)

(73) Assignee: CSV Industries, LLC, Albion, NE (US)

( * ) Notice: Subject to any disclaimer, the term of this patent is extended or adjusted under 35 U.S.C. 154(b) by 398 days.

(21) Appl. No.: 12/758,094

(22) Filed: Apr. 12, 2010

(65) Prior Publication Data

US 2011/0250936 A1 Oct. 13, 2011

(51) Int. Cl.
*A63B 69/00* (2006.01)

(52) U.S. Cl.
USPC ..... 473/456; 473/458

(58) Field of Classification Search
USPC ..... 472/456, 458; 463/2
See application file for complete search history.

(56) References Cited

U.S. PATENT DOCUMENTS 4,497,485 A * 2/1985 Macosko ..... 473/435
4,781,376 A * 11/1988 Barnes, Sr. ..... 473/455
4,868,772 A 9/1989 Collard
5,333,855 A * 8/1994 Silin et al. ..... 473/455
7,341,530 B2 3/2008 Cavallaro et al.
2003/0051718 A1* 3/2003 Battersby et al. ..... 124/78
2005/0187036 A1* 8/2005 Ziola et al. ..... 473/372
2008/0248901 A1 10/2008 Mosier et al.
2010/0041498 A1* 2/2010 Adams ..... 473/451
2010/0081524 A1* 4/2010 Husband ..... 473/451

FOREIGN PATENT DOCUMENTS

WO WO2009070140 A1 6/2009

* cited by examiner

*Primary Examiner* — Dmitry Suhol
*Assistant Examiner* — Carl V Larsen
(74) *Attorney, Agent, or Firm* — Suiter Swantz pc llo

(57) ABSTRACT

The present invention provides a visual representation of and unique, universal definition for a strike zone, said strike zone having a plurality of sub-zones. The strike zone representation allows for a signaling methodology to be developed in which a coach may discretely communicate signals during a game to his pitcher (ex.—baseball or softball pitcher) which request both a specific type and location for a particular pitch, based upon the game situation. Further, implementation of said signaling methodology based upon said strike zone representation allows for a performance factor to be determined for the pitcher. The performance factor may be determined based on results generated through use of the signaling methodology and may provide a universally-recognized gauge or measure of a pitcher's command of his pitches.

16 Claims, 6 Drawing Sheets

SYSTEM AND METHOD FOR PROVIDING A PERFORMANCE FACTOR FOR A PITCHER

FIELD OF THE INVENTION

The present invention relates to the field of athletic performance and particularly to a system and method for providing a performance factor for a pitcher (exs.—a baseball pitcher, a softball pitcher, etc.).

BACKGROUND OF THE INVENTION

Over the last 10-15 years baseball (and softball) coaches at all levels of the sport have become more involved with in-game strategy on a pitch-by-pitch basis. Many coaches now attempt to control the type of pitches his pitcher throws during a game by providing signals from the dugout or coaching box. For instance, a coach may signal the type of pitch (exs.—fastball, slider, curve, change-up, etc.) he wants the pitcher to throw based upon a game situation and/or game factors (exs.—the hitter who is batting, the number of runners on base, etc.). When providing the signals from the dugout, the coach may provide said signals either directly to the pitcher, or to the catcher, who may then relay the signals to the pitcher.

Numerical signal systems for signaling the type of pitch to be thrown have long been in existence. In such systems, a coach may provide signals indicating the type of pitch he wants the pitcher to throw by using his hands to signal a number associated with a type of pitch. For example, the coach may signal a number "1" if he wants the pitcher to throw a fastball, a number "2" if he wants the pitcher to throw a curve, a number "3" if he wants the pitcher to throw a slider, a number "4" if he wants the pitcher to throw a change-up, and a number "5" if he wants the pitcher to throw a different type of pitch than those mentioned above (exs.—sinker, knuckleball, screwball, forkball, pitch out, etc.). Over the years, it has been relatively easy for coaches to disguise the above-referenced signals from opposing team members by using such tactics as providing a sequential series of signals where only one of the signals in the series (decided upon beforehand by the coach and his players) is the true signal, or having multiple coaches and/or players send in signals at the same time, with only one of those coaches/players (the identity of whom is known only by the coach and his players) being the one sending in the true signals.

Alternatively, when it comes to signaling a location where the coach wants the pitch to be thrown, no practical system for doing so currently exists. In some current available systems, a coach may use verbal signals such as "keep it low" or may point to areas on his body to signal a desired location where he wants the pitcher to throw a given pitch. However, such currently available systems may not provide sufficient detail to the pitcher for communicating the exact desired location where the coach wants the ball thrown and further, may not provide a way for the signals to be easily disguised.

Thus, it would be desirable to provide a signaling system/method which obviates the problems associated with currently available signaling systems.

SUMMARY OF THE INVENTION

Accordingly, an embodiment of the present invention is directed to a non-transitory computer-readable medium having computer-executable instructions for performing a method for providing a performance factor for a pitcher, said method including: receiving a first input, the first input providing a first location for a first pitch; receiving a second input, the second input providing a second location for the first pitch; comparing the first location for the first pitch to the second location for the first pitch; assigning an accuracy measurement for the first pitch based upon said comparing; receiving a third input, the third input providing a first location for a second pitch; receiving a fourth input, the fourth input providing a second location for the second pitch; comparing the first location for the second pitch to the second location for the second pitch; assigning an accuracy measurement for the second pitch based upon said comparing of the first location for the second pitch to the second location for the second pitch; calculating the performance factor based upon the accuracy measurement for the first pitch and the accuracy measurement for the second pitch; and outputting the calculated performance factor.

A further embodiment of the present invention is directed to a non-transitory computer-readable medium having computer-executable instructions for performing a method for providing a performance factor for a pitcher, said method including: receiving a first input and a second input, the first input providing a first location associated with a first pitch, the second input providing a second location associated with the first pitch; receiving a third input and a fourth input, the third input providing a first pitch type associated with the first pitch, the fourth input providing a second pitch type associated with the first pitch; comparing the first location associated with the first pitch to the second location associated with the first pitch; assigning an accuracy measurement for the first pitch based upon said comparing of the first location to the second location; comparing the first pitch type associated with the first pitch to the second pitch type associated with the first pitch; assigning a consistency measurement for the first pitch based upon said comparing of the first pitch type to the second pitch type; receiving a fifth input and a sixth input, the fifth input providing a first location associated with a second pitch, the sixth input providing a second location associated with the second pitch; receiving a seventh input and an eighth input, the seventh input providing a first pitch type associated with the second pitch, the eighth input providing a second pitch type associated with the second pitch; comparing the first location associated with the second pitch to the second location associated with the second pitch; assigning an accuracy measurement for the second pitch based upon said comparing of the first location associated with the second pitch to the second location associated with the second pitch; comparing the first pitch type associated with the second pitch to the second pitch type associated with the second pitch; assigning a consistency measurement for the second pitch based upon said comparing of the first pitch type associated with the second pitch to the second pitch type associated with the second pitch; calculating the performance factor based upon the accuracy measurement for the first pitch, the accuracy measurement for the second pitch, the consistency measurement for the first pitch, and the consistency measurement for the second pitch; and outputting the calculated performance factor.

A still further embodiment of the present invention is directed to a system of protective gear configured for being worn by a catcher, comprising: a chest protector, the chest protector being configured with a representation of a first sub-zone of a strike zone, a representation of a second sub-zone of the strike zone; and a representation of a third sub-zone of the strike zone; a first knee guard, the first knee guard being configured with a representation of a fourth sub-zone of the strike zone; and a second knee guard, the second knee guard being configured with a representation of a fifth sub-zone of the strike zone, wherein the representations are configured for providing visual cues to a pitcher for promoting recall of locations associated with the first sub-zone, second sub-zone, third sub-zone, fourth sub-zone and fifth sub-zone of the strike zone.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
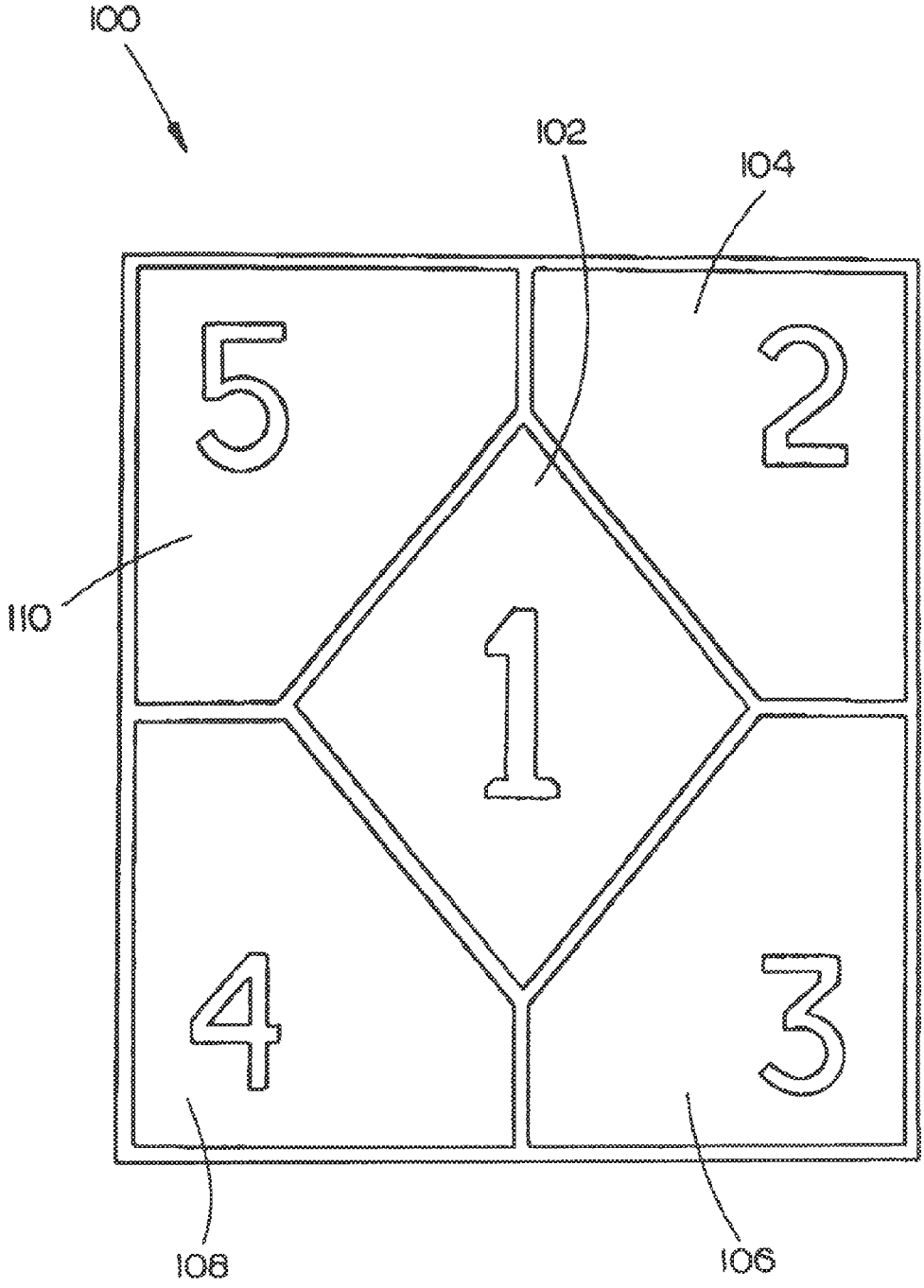
FIG. 1 is a view of a representation of a strike zone, said strike zone including a plurality of sub-zones in accordance with an exemplary embodiment of the present invention.

In baseball (or softball), the strike zone may be defined as a conceptual rectangular area over home plate which defines the boundaries through which a pitch must pass in order to count as a strike when the batter does not swing. Referring generally to FIG. 1, a representation of a strike zone in accordance with an exemplary embodiment of the present invention is shown. In current embodiments of the present invention, the representation of the strike zone 100 may be rectangular-shaped and may include a plurality of sub-zones. For example, in the illustrated embodiment of the present invention, the representation of the strike zone 100 may include five sub-zones (102, 104, 106, 108, 110). The first sub-zone 102 may be represented via a diamond shape and may be centrally located within the strike zone representation 100. In alternative embodiments, the first sub-zone 102 may be represented via a square shape, a rectangular shape, a circular shape, an oval shape, or the like. The second through fifth sub-zones (104, 106, 108, 110) may be represented via similar shapes (ex.—pentagonal shapes) which are connected to (ex.—surround) the first sub-zone 102 and may form the upper right, lower right, lower left and upper left regions (ex.—corners) of the strike zone 100 respectively. In further exemplary embodiments, the second through fifth sub-zones (104, 106, 108, 110) may be equally sized. In alternative embodiments, the second through fifth sub-zones (104, 106, 108, 110) may be different sizes and/or shapes. Still further, each of the sub-zones may be further represented via unique corresponding numerals (ex.—the first sub-zone 102 may be represented by and/or associated with the numeral "1", the second sub-zone 104 may be associated with the numeral "2", the third sub-zone 106 may be associated with the numeral "3", the fourth sub-zone 108 may be associated with the numeral "4", and the fifth sub-zone 110 may be associated with the numeral "5". As shown in the illustrated embodiment, the second sub-zone 104 may be connected to (ex.—adjacent to) the third and fifth sub-zones (106 and 110), the third sub-zone 106 may be connected to (ex.—adjacent to) the second and fourth sub-zones (104 and 108), the fourth sub-zone 108 may be connected to (ex.—adjacent to) the third and fifth sub-zones (106, 110) and the fifth sub-zone 110 may be connected to (ex.—adjacent to) the second and fourth sub-zones (104, 108). In still further embodiments, each of the sub-zones may be further represented via unique corresponding colors and/or letters.

In exemplary embodiments of the present invention, the strike zone representation 100 of the present invention provides a universal definition of the strike zone, which may allow said representation 100 to be easily implemented with numerical signaling systems. For example, a numerical signaling system may be developed which allows a coach/manager to signal both a type of pitch (exs.—fastball, curve, etc.) that the manager wants the pitcher to throw and a location within the strike zone 100 where the manager wants the pitch to be thrown to (ex.—down the middle, upper inside corner, lower outside corner, etc.). In a current exemplary embodiment of the present invention, a signaling system may be implemented in which the coach may signal a first number which represents the type of pitch he wants thrown. For instance, the coach may signal a number "1" if he wants the pitcher to throw a fastball, a number "2" if he wants the pitcher to throw a curve, a number "3" if he wants the pitcher to throw a slider, a number "4" if he wants the pitcher to throw a change-up, and a number "5" if he wants the pitcher to throw a different type of pitch than those mentioned above (exs.—sinker, knuckleball, screwball, forkball, pitch out, etc.).

Further, in said signaling system of the present invention, the coach may signal a second number which represents a location within the strike zone 100 where he wants the pitch to be thrown to. For example, the coach may signal a number "1" if he wants the pitcher to throw a pitch to the first sub-zone 102 (ex.—the middle of the strike zone), a number "2" if he wants the pitcher to throw a pitch to the second sub-zone 104 (ex.—the upper right hand portion of the strike zone when viewed from the pitcher's perspective standing on the pitcher's mound and throwing towards home plate), a number "3" if he wants the pitcher to throw a pitch to the third sub-zone 106 (ex.—the lower right hand portion of the strike zone), a number "4" if he wants the pitcher to throw a pitch to the fourth sub-zone 108 (ex.—the lower left hand portion of the strike zone), and a number "5" if he wants the pitcher to throw a pitch to the fifth sub-zone 110 (ex.—the upper left hand portion of the strike zone). Thus, various two digit signals (exs.—11-15, 21-25, 31-35, 41-45 and 51-55) may be provided by the coach for requesting a desired type of pitch and a desired location (ex.—within the strike zone) for a pitch. For instance, the number "44" may be used by the coach to signal that he wants a change-up thrown to the fourth sub-zone 108 (ex.—lower left hand portion of the strike zone), while a "32" may be used to signal a slider thrown to the second sub-zone 104 (ex.—upper right hand portion of the strike zone). In alternative embodiments, a signaling system, as described above, may be adapted in which the sequence could be reversed, such that the first digit signals the desired location, while the second digit signals the desired pitch type. Further, the two digit signal may be a visual signal or an audible signal.

In current exemplary embodiments of the present invention, numerical signaling systems based upon the strike zone 100 of the present invention may be implemented in other devices for promoting ease of implementation of and/or ease of learning of said numerical signaling systems. For example, instructional materials, such as a DVD, CD-ROM, or the like for communicating information about the strike zone 100 and how to implement said numerical signaling system(s) may be provided. Further, flash cards which may be used for teaching and communicating signals of said numerical signaling system(s) based upon said strike zone 100 may also be provided.

Figure 2:
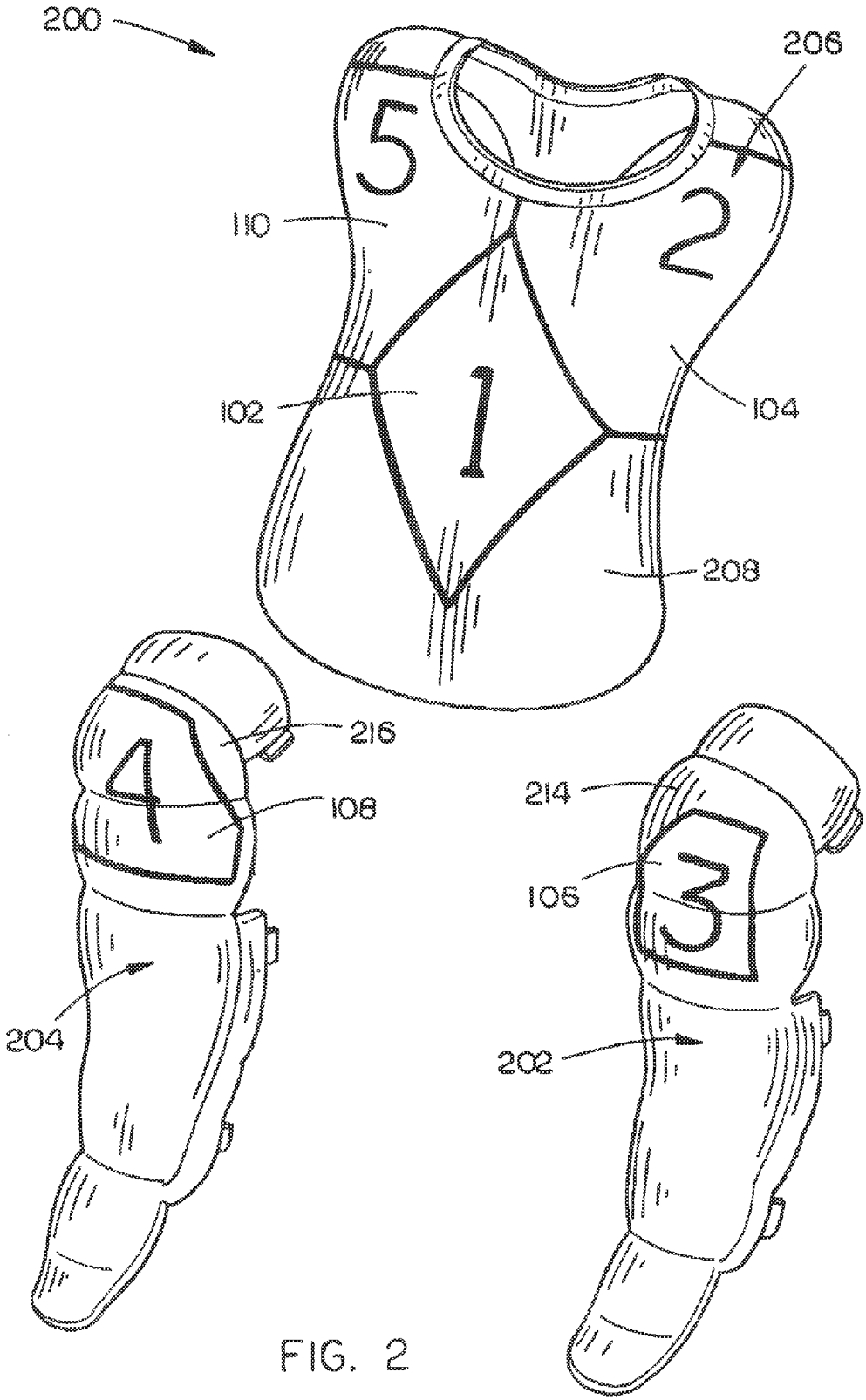
FIG. 2 is a view of protective gear configured for being worn by a catcher, said protective gear including representations of sub-zones of the strike zone shown in FIG. 1, in accordance with an exemplary embodiment of the present invention.

In further embodiments of the present invention, the representation of the strike zone 100 shown in FIG. 1 may be configured on various equipment for promoting learning, memorization and recall of the strike zone 100. In an exemplary embodiment of the present invention, the representation of the strike zone 100 may be configured on gear (ex.—protective gear) worn by a catcher, as shown in FIG. 2. In the illustrated embodiment of the present invention, the representation of the strike zone 100 may be configured on a system of protective gear 200 which includes leg guards (202, 204) and a chest protector 206, each configured for being worn by a catcher.

In exemplary embodiments of the present invention, the chest protector 206 may be configured with a representation of the first sub-zone 102 of the strike zone 100. For example, the representation of the first sub-zone 102 of the strike zone 100 may be established at a generally central location on a surface (ex.—front surface) 208 of the chest protector 206. In further embodiments, the front surface 208 of the chest protector 206 may be further configured with a representation of the second sub-zone 104 of the strike zone 100 and a representation of the fifth sub-zone 110 of the strike zone 100. For instance, the representations of the second sub-zone 104 and the fifth sub-zone 110 of the strike zone 100 may be established on upper left and upper right (ex.—front shoulder cover) portions (210, 212) respectively of the chest protector 206.

Figure 3:
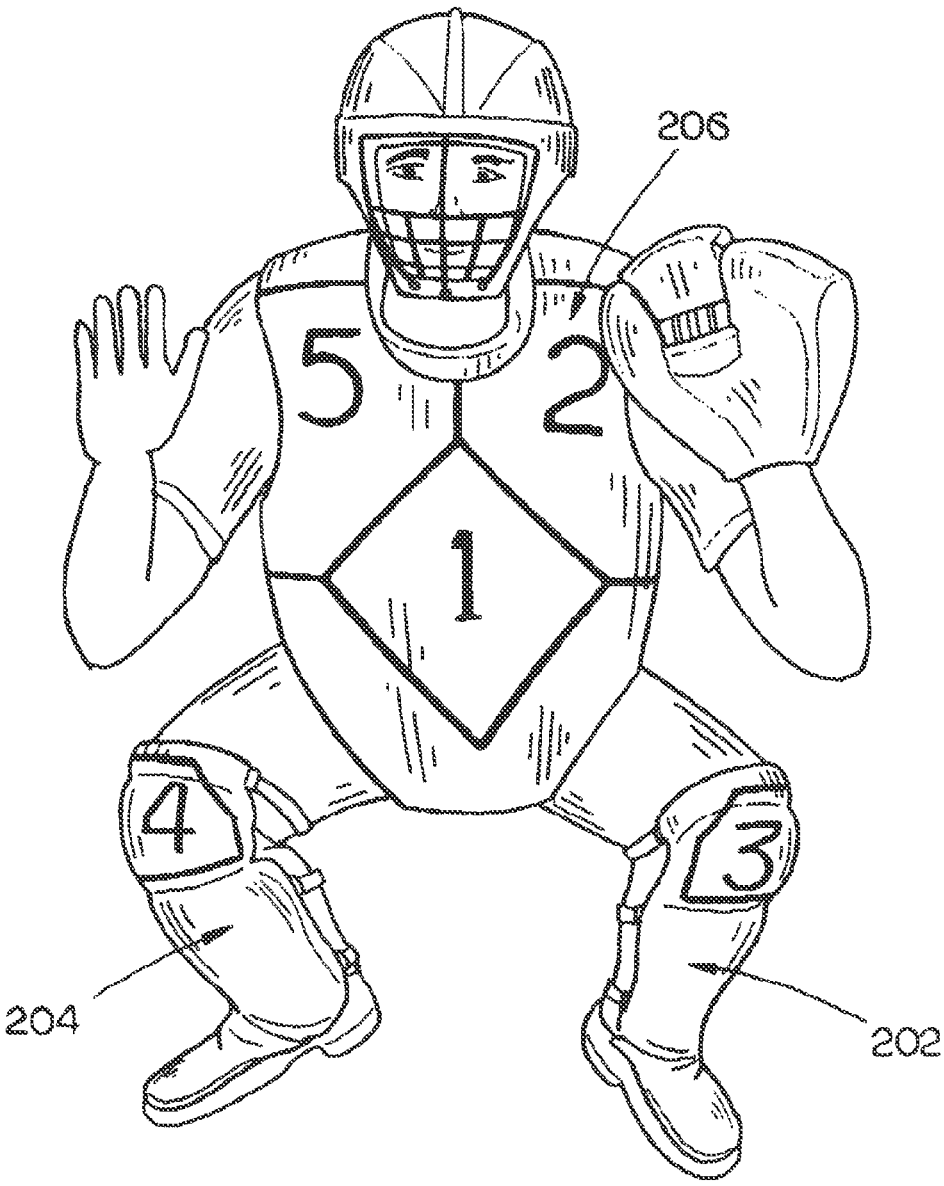
FIG. 3 is a view of the protective gear of FIG. 2, shown being worn by a catcher in accordance with a further exemplary embodiment of the present invention.

In further embodiments of the present invention, a first leg guard (ex.—a left leg guard) 202 may be configured with a representation of the third sub-zone 106 of the strike zone 100 and a second leg guard (ex.—a right leg guard) 204 may be configured with a representation of the fourth sub-zone 108 of the strike zone 100. For instance, the representations of the third sub-zone 106 and the fourth sub-zone 108 may be configured on left and right knee cover portions (214, 216) respectively of the leg guards (202, 204). In exemplary embodiments of the present invention, the representations of the first through fifth sub-zones (102, 104, 106, 108, 110) of the strike zone 100 may be both sized and located for being visible (ex.—readable) from a distance of at least sixty feet away, such that a pitcher standing on a pitcher's mound facing the catcher (who is positioned behind home plate in a traditional catcher's crouch) and facing the pitcher) may be able to view and read the sub-zone representations (102, 104, 106, 108, 110) configured on the catcher's gear 200. (as shown in FIG. 3). Such equipment may promote ease of learning and recall of where the particular sub-zones (102, 104, 106, 108, 110) of the strike zone 100 are located, which may allow the pitcher to more easily recall where he needs to throw a pitch when his coach provides a signal requesting that the pitcher throw the ball into a particular sub-zone.

In alternative embodiments of the present invention, the representation of the strike zone 100 (representations of the sub-zones) may be configured on other gear, equipment, and/or devices for promoting learning and recall of the strike zone 100. In at least one embodiment, the representation of the strike zone 100 may be configured on a pitching canvas to provide a target for a pitcher to hit when throwing pitches during practice, which also provides a visually recallable image of the strike zone 100 of the present invention. The pitcher's canvas may also be configured with representations of a right-handed batter and/or a left-handed batter. In further embodiments, the representation of the strike zone 100 may be configured on a clipboard or pin-up sheets, which may, for instance, be configured for being hung (ex.—posted) in a dugout for providing a visual reminder to the players and coaches of the strike zone 100 for promoting learning and recall of the strike zone 100.

In further embodiments of the present invention, the representation of the strike zone 100, by providing a universal, recallable idea or definition of the strike zone, allows for a standardized measure of a pitcher's control to be developed based upon said strike zone 100 and signaling systems (ex.—numerical signaling systems) which are implemented based upon said strike zone 100. Such standardized measure of a pitcher's control may be known as The Pitcher's Spot (TPS) factor, which provides a measure of how consistently a pitcher is able to throw a pitch where he is asked to throw it (ex.—or how consistently a pitcher is able to hit is intended "spots" or sub-zones of the strike zone 100). The TPS factor, due to its being based upon the strike zone 100 of the present invention, may become a universal or standardized statistical measure of pitching performance, much like Earned Run Average (ERA).

In exemplary embodiments of the present invention, determination of TPS factor may include comparing an intended location for a thrown pitch (ex.—a sub-zone that was signaled by the coach) with an actual location of the thrown pitch (ex.—sub-zone, spot or location where the thrown pitch actually ended up). In further embodiments of the present invention, such comparing may be done for all of the pitches thrown by the pitcher in a particular game (or during a particular season, inning, etc.), and a determination of what percentage of those pitches actually ended up at their intended location may be calculated, with said percentage being the TPS factor. Thus, the TPS factor may provide a universal measure of a pitcher's command of his pitches (exs.—ability to accurately hit his "spots", consistency with which he is able to throw his pitches to the sub-zones signaled by a member of the pitcher's team (ex.—coach, catcher, etc.). In further embodiments of the present invention, determination of TPS factor may be based upon: 1) how often a pitcher is able to throw a pitch into the signaled sub-zone; and 2) how often a pitcher throws the type of pitch (exs.—fastball, slider, curve) that was signaled. In still further embodiments of the present invention, instructional materials (ex.—a DVD) may be provided for teaching how TPS factor may be calculated. In additional embodiments of the present invention, a scorebook may be provided which includes areas for allowing a user to record data (exs.—signaled pitch location, signaled pitch type, actual pitch location, actual pitch type) which may be used in determining TPS factor. In further embodiments of the present invention, a computing device and/or computer program product may also be implemented for determining TPS factor.

Figure 4:
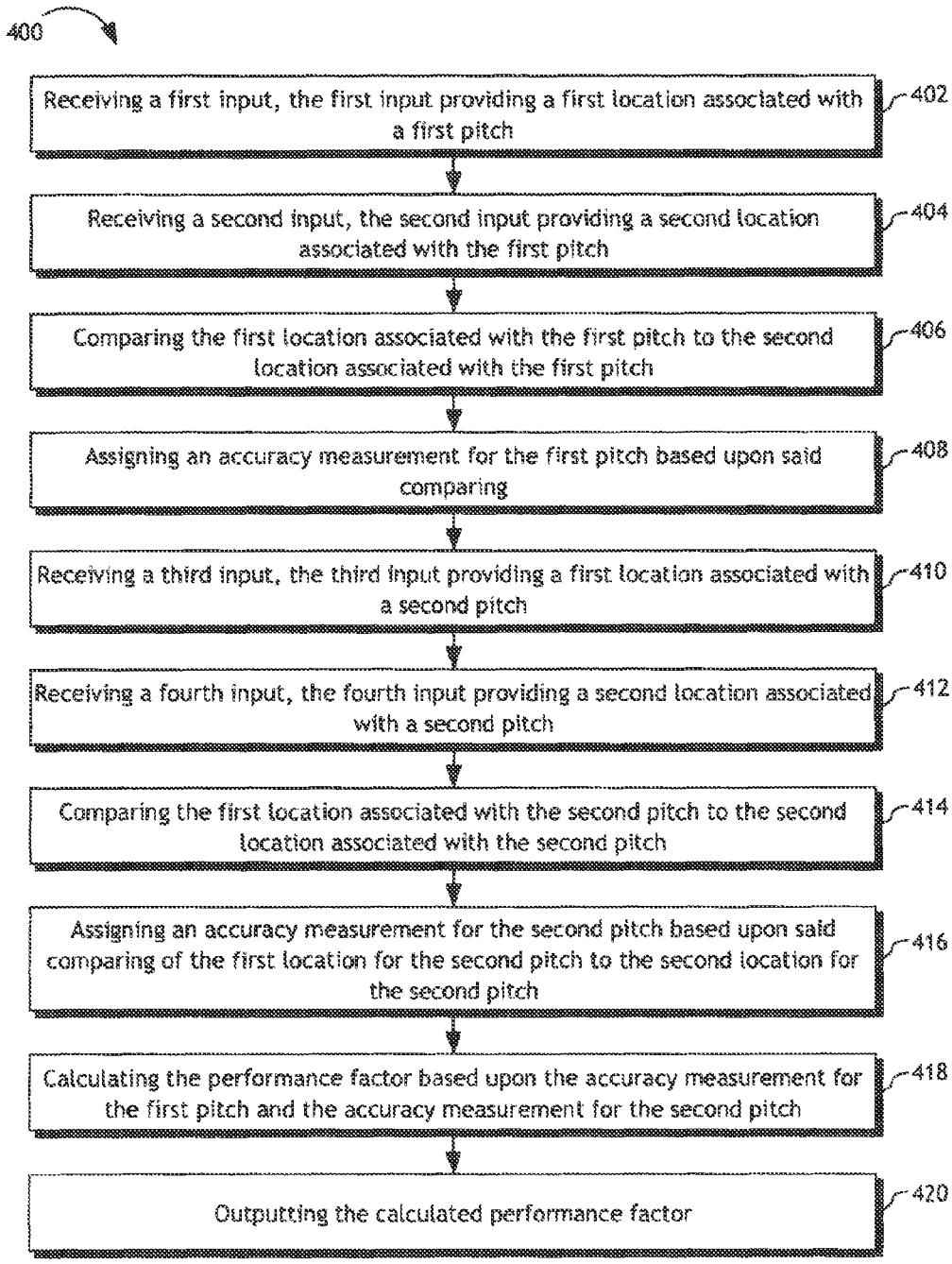
FIG. 4 depicts a flowchart illustrating a method for providing a performance factor for a pitcher in accordance with an exemplary embodiment of the present invention.

Referring generally to FIG. 4, a flowchart illustrating a method for providing a performance factor (ex.—TPS factor) for a pitcher in accordance with an exemplary embodiment of the present invention is shown. The method 400 may include the step of receiving a first input, the first input providing a first location (ex.—a signaled and/or intended location or sub-zone in the strike zone 100) associated with a first pitch 402. For example, the signaled and/or intended location may be within one of the five sub-zones (102, 104, 106, 108, 110) of the strike zone 100 or may be outside of the strike zone 100, such as if a pitchout is called). The method 400 may further include the step of receiving a second input, the second input providing a second location (ex.—an actual location or sub-zone of the strike zone 100 where the pitch was thrown to) associated with the first pitch 404. For instance, the actual location where the pitch was thrown to may be outside of the strike zone 100 or may be within one of the five sub-zones within the strike zone 100 other than the intended or signaled sub-zone). The method 400 may further include the step of comparing the first location associated with the first pitch to the second location associated with the first pitch 406 (ex.—determining whether the actual location or sub-zone where the first pitch was thrown to matched the intended (signaled) sub-zone for the first pitch). The method 400 may further include the step of assigning an accuracy measurement for the first pitch based upon said comparing 408. The method 400 may further include the step of receiving a third input, the third input providing a first location associated with a second pitch 410. The method 400 may further include receiving a fourth input, the fourth input providing a second location associated with the second pitch 412. The method 400 may further include comparing the first location associated with the second pitch to the second location associated with the second pitch 414. The method 400 may further include assigning an accuracy measurement for the second pitch based upon said comparing of the first location for the second pitch to the second location for the second pitch 416. The method 400 may further include the step of calculating the performance factor (ex.—TPS factor) based upon the accuracy measurement for the first pitch and the accuracy measurement for the second pitch 418. The method 400 may further include the step of outputting the calculated performance factor 420.

Figure 5A:
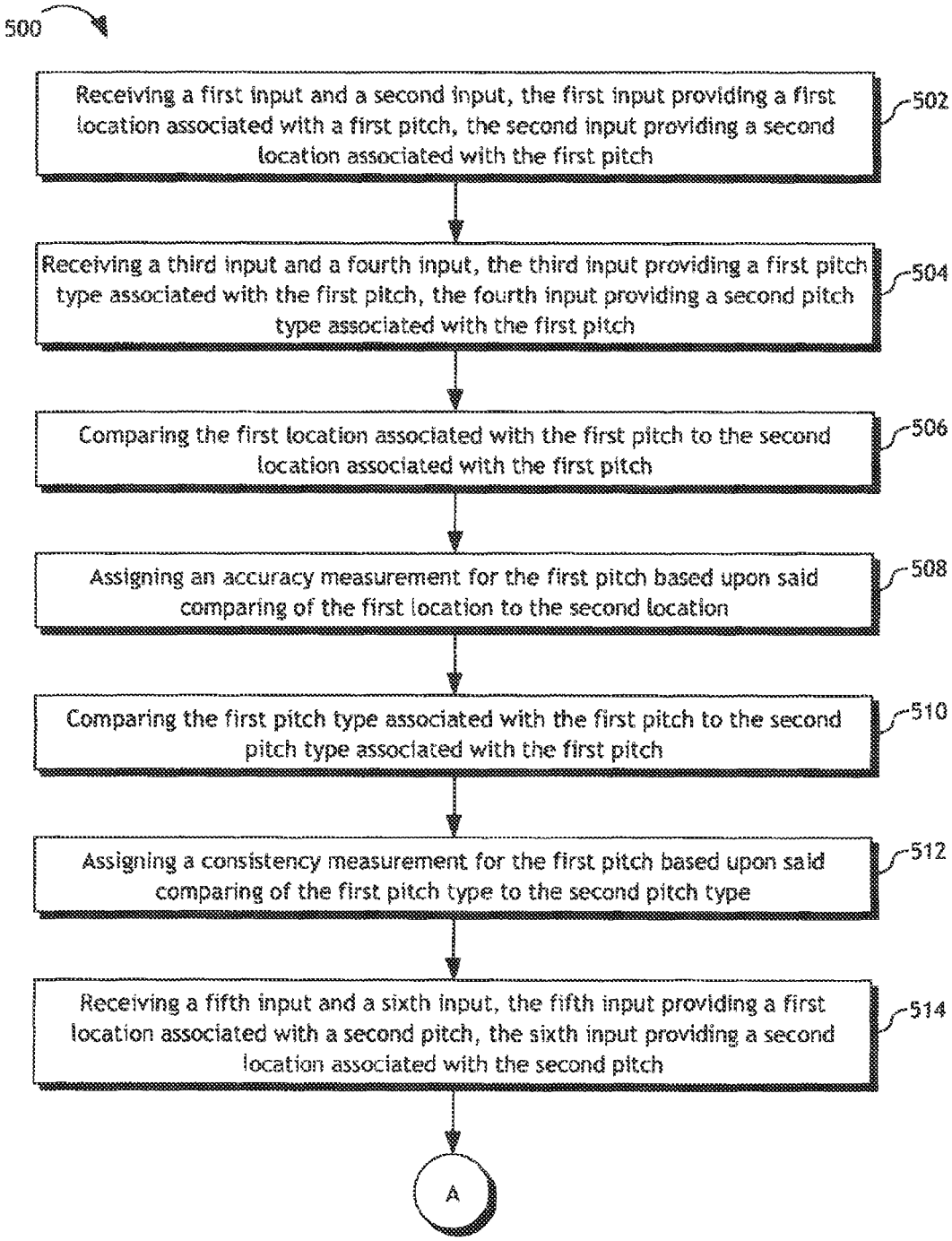
FIGS. 5A and 5B depict a flowchart illustrating a method for providing a performance factor for a pitcher in accordance with a further exemplary embodiment of the present invention.
Figure 5B:
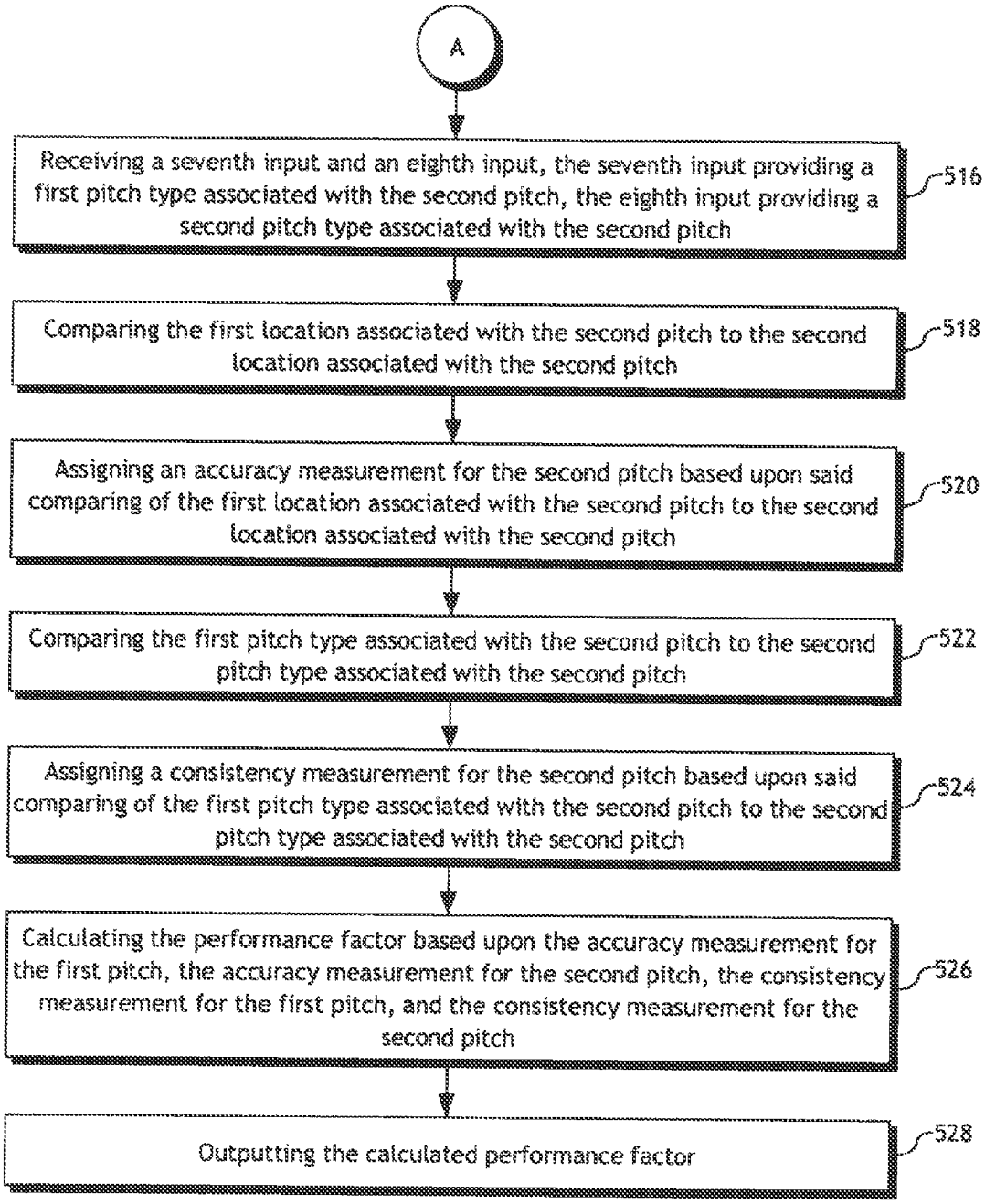

Referring generally to FIGS. 5A and 5B, a flowchart illustrating a method for providing a performance factor for a pitcher in accordance with an alternative exemplary embodiment of the present invention is shown. The method 500 may include the step of receiving a first input and a second input, the first input providing a first location associated with a first pitch, the second input providing a second location associated with the first pitch 502. The method 500 may further include the step of receiving a third input and a fourth input, the third input providing a first pitch type associated with the first pitch, the fourth input providing a second pitch type associated with the first pitch 504. The method 500 may further include the step of comparing the first location associated with the first pitch to the second location associated with the first pitch 506. The method 500 may further include the step of assigning an accuracy measurement for the first pitch based upon said comparing of the first location to the second location 508. The method 500 may further include the step of comparing the first pitch type associated with the first pitch to the second pitch type associated with the first pitch 510. The method 500 may further include the step of assigning a consistency measurement (exs.—measurement indicating that the first pitch type and second pitch type associated with the first pitch matched or, a measurement indicating that the first pitch type and second pitch type associated with the first pitch didn't match) for the first pitch based upon said comparing of the first pitch type to the second pitch type 512. The method 500 may further include the step of receiving a fifth input and a sixth input, the fifth input providing a first location associated with a second pitch, the sixth input providing a second location associated with the second pitch 514. The method 500 may further include the step of receiving a seventh input and an eighth input, the seventh input providing a first pitch type associated with the second pitch, the eighth input providing a second pitch type associated with the second pitch 516. The method 500 may further include the step of comparing the first location associated with the second pitch to the second location associated with the second pitch 518. The method 500 may further include the step of assigning an accuracy measurement for the second pitch based upon said comparing of the first location associated with the second pitch to the second location associated with the second pitch 520. The method 500 may further include the step of comparing the first pitch type associated with the second pitch to the second pitch type associated with the second pitch 522. The method 500 may further include the step of assigning a consistency measurement (exs.—measurement indicating that the first pitch type and second pitch type associated with the second pitch matched or, a measurement indicating that the first pitch type and second pitch type associated with the second pitch didn't match) for the second pitch based upon said comparing of the first pitch type associated with the second pitch to the second pitch type associated with the second pitch 524. The method 500 may further include the step of calculating the performance factor based upon the accuracy measurement for the first pitch, the accuracy measurement for the second pitch, the consistency measurement for the first pitch, and the consistency measurement for the second pitch 526. The method 500 may further include the step of outputting the calculated performance factor 528.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A non-transitory computer-readable medium having computer-executable instructions for performing a method for providing a performance factor for a pitcher, said method comprising:

receiving a first input, the first input providing a first location for a first pitch, said first location comprising a zone identified on one of a chest protector, a first knee guard and a second knee guard;

receiving a second input, the second input providing a second location for the first pitch, said second location comprising a zone identified on one of a chest protector, a first knee guard and a second knee guard;

comparing the first location for the first pitch to the second location for the first pitch; and assigning an accuracy measurement for the first pitch based upon said comparing.

2. A non-transitory computer-readable medium having computer-executable instructions for performing a method for providing a performance factor for a pitcher, as claimed in claim 1, further comprising:

receiving a third input, the third input providing a first location for a second pitch, said first location comprising a zone identified on one of a chest protector, a first knee guard and a second knee guard.

3. A non-transitory computer-readable medium having computer-executable instructions for performing a method for providing a performance factor for a pitcher, as claimed in claim 2, further comprising:

receiving a fourth input, the fourth input providing a second location for the second pitch, said second location comprising a zone identified on one of a chest protector, a first knee guard and a second knee guard.

4. A non-transitory computer-readable medium having computer-executable instructions for performing a method for providing a performance factor for a pitcher, as claimed in claim 3, further comprising:

comparing the first location for the second pitch to the second location for the second pitch.

5. A non-transitory computer-readable medium having computer-executable instructions for performing a method for providing a performance factor for a pitcher, as claimed in claim 4, further comprising:

assigning an accuracy measurement for the second pitch based upon said comparing of the first location for the second pitch to the second location for the second pitch.

6. A non-transitory computer-readable medium having computer-executable instructions for performing a method for providing a performance factor for a pitcher, as claimed in claim 5, further comprising:

calculating the performance factor based upon the accuracy measurement for the first pitch and the accuracy measurement for the second pitch.

7. A non-transitory computer-readable medium having computer-executable instructions for performing a method for providing a performance factor for a pitcher, as claimed in claim 6, further comprising:

outputting the calculated performance factor.

8. A non-transitory computer-readable medium having computer-executable instructions for performing a method for providing a performance factor for a pitcher, as claimed in claim 7, wherein at least one of the first location for the first pitch and the first location for the second pitch is within one of five sub-zones of a strike zone, said strike zone consisting of the five sub-zones.

9. A non-transitory computer-readable medium having computer-executable instructions for performing a method for providing a performance factor for a pitcher, said method comprising:

receiving a first input and a second input, the first input providing a first location associated with a first pitch, said first location comprising a zone identified on one of a chest protector, a first knee guard and a second knee guard, the second input providing a second location associated with the first pitch, said second location comprising a zone identified on one of a chest protector, a first knee guard and a second knee guard;

receiving a third input and a fourth input, the third input providing a first pitch type associated with the first pitch, the fourth input providing a second pitch type associated with the first pitch;

comparing the first location associated with the first pitch to the second location associated with the first pitch; and assigning an accuracy measurement for the first pitch based upon said comparing of the first location to the second location.

10. A non-transitory computer-readable medium having computer-executable instructions for performing a method for providing a performance factor for a pitcher, as claimed in claim 9, further comprising:

comparing the first pitch type associated with the first pitch to the second pitch type associated with the first pitch.

11. A non-transitory computer-readable medium having computer-executable instructions for performing a method for providing a performance factor for a pitcher, as claimed in claim 10, further comprising:

assigning a consistency measurement for the first pitch based upon said comparing of the first pitch type to the second pitch type.

12. A non-transitory computer-readable medium having computer-executable instructions for performing a method for providing a performance factor for a pitcher, as claimed in claim 11, further comprising:

receiving a fifth input and a sixth input, the fifth input providing a first location associated with a second pitch, said first location comprising a zone identified on one of a chest protector, a first knee guard and a second knee guard, the sixth input providing a second location associated with the second pitch, said second location comprising a zone identified on one of a chest protector, a first knee guard and a second knee guard; and receiving a seventh input and an eighth input, the seventh input providing a first pitch type associated with the second pitch, the eighth input providing a second pitch type associated with the second pitch.

13. A non-transitory computer-readable medium having computer-executable instructions for performing a method for providing a performance factor for a pitcher, as claimed in claim 12, further comprising:

comparing the first location associated with the second pitch to the second location associated with the second pitch; and assigning an accuracy measurement for the second pitch based upon said comparing of the first location associated with the second pitch to the second location associated with the second pitch.

14. A non-transitory computer-readable medium having computer-executable instructions for performing a method for providing a performance factor for a pitcher, as claimed in claim 13, further comprising:

comparing the first pitch type associated with the second pitch to the second pitch type associated with the second pitch; and assigning a consistency measurement for the second pitch based upon said comparing of the first pitch type associated with the second pitch to the second pitch type associated with the second pitch.

15. A non-transitory computer-readable medium having computer-executable instructions for performing a method for providing a performance factor for a pitcher, as claimed in claim 14, further comprising:

calculating the performance factor based upon the accuracy measurement for the first pitch, the accuracy measurement for the second pitch, the consistency measurement for the first pitch, and the consistency measurement for the second pitch; and outputting the calculated performance factor.

16. A non-transitory computer-readable medium having computer-executable instructions for performing a method for providing a performance factor for a pitcher, as claimed in claim 15, wherein at least one of the first location for the first pitch and the first location for the second pitch is within one of five sub-zones of a strike zone, said strike zone consisting of the five sub-zones.

* * * * *